US011377741B2

(12) United States Patent
Englert et al.

(10) Patent No.: US 11,377,741 B2
(45) Date of Patent: Jul. 5, 2022

(54) METHOD FOR PRODUCING A HEAT EXCHANGER

(71) Applicant: Mahle International GmbH, Stuttgart (DE)

(72) Inventors: Peter Englert, Bad Friedrichshall (DE); Thomas Gebauer, Oestringen (DE)

(73) Assignee: Mahle International GmbH

( * ) Notice: Subject to any disclaimer, the term of this patent is extended or adjusted under 35 U.S.C. 154(b) by 409 days.

(21) Appl. No.: 15/961,810

(22) Filed: Apr. 24, 2018

(65) Prior Publication Data

US 2018/0305820 A1 Oct. 25, 2018

(30) Foreign Application Priority Data

Apr. 25, 2017 (DE) ..... 102017206940.6

(51) Int. Cl.

| | |
|---|---|
| ***C23C 22/46*** | (2006.01) |
| ***F28F 13/18*** | (2006.01) |
| ***C23C 22/78*** | (2006.01) |
| ***C23G 1/00*** | (2006.01) |
| ***C23G 1/12*** | (2006.01) |
| ***C23C 22/56*** | (2006.01) |
| *F28F 21/08* | (2006.01) |
| *F28D 21/00* | (2006.01) |
| *F28F 19/02* | (2006.01) |

(52) U.S. Cl.

CPC ..... *C23C 22/46* (2013.01); *C23C 22/56* (2013.01); *C23C 22/78* (2013.01); *C23G 1/00* (2013.01); *C23G 1/125* (2013.01); *F28F 13/18* (2013.01); *F28D 2021/0043* (2013.01); *F28F 19/02* (2013.01); *F28F 21/084* (2013.01); *F28F 2245/02* (2013.01)

(58) Field of Classification Search

CPC ..... C23C 22/46; C23C 22/56; C23C 22/78; C23G 1/00; C23G 1/125; F28F 13/18

See application file for complete search history.

(56) References Cited

U.S. PATENT DOCUMENTS

| | | | | |
|---|---|---|---|---|
| 3,565,699 | A * | 2/1971 | Paxton | C23C 22/83 428/341 |
| 5,750,197 | A | 5/1998 | van Ooij et al. | |
| 5,952,049 | A * | 9/1999 | Tomlinson | C23C 22/34 148/247 |
| 6,287,704 | B1 | 9/2001 | Preikschat et al. | |
| 6,306,226 | B1 * | 10/2001 | Iino | B05D 7/51 148/247 |
| 7,438,121 | B2 | 10/2008 | Minami et al. | |
| 2002/0192511 | A1 | 12/2002 | Hruschka et al. | |
| 2004/0256089 | A1 | 12/2004 | Kobayashi et al. | |
| 2009/0045379 | A1 * | 2/2009 | Pellet | C23F 11/184 252/387 |
| 2010/0227179 | A1 * | 9/2010 | Pfeiffer | C23C 22/53 428/457 |
| 2011/0041958 | A1 * | 2/2011 | Sato | C23C 22/78 148/252 |
| 2011/0126419 | A1 | 6/2011 | Castillo Fernandez et al. | |
| 2015/0013947 | A1 * | 1/2015 | Matsui | F28F 21/084 165/133 |
| 2016/0230290 | A1 * | 8/2016 | Kamimura | C11D 11/0029 |

FOREIGN PATENT DOCUMENTS

| | | | |
|---|---|---|---|
| CN | 101809201 | A | 8/2010 |
| DE | 15 21 679 | A1 | 10/1969 |
| DE | 34 13416 | A1 | 10/1984 |
| DE | 37 44 032 | A1 | 7/1988 |
| DE | 196 15 664 | A1 | 10/1997 |
| DE | 101 63 337 | A1 | 7/2003 |
| DE | 698 11818 | T2 | 5/2004 |
| DE | 10 2006 033 465 | A1 | 1/2008 |
| DE | 10 2007 057 777 | A1 | 6/2009 |
| DE | 10 2009 013 054 | A1 | 9/2010 |
| DE | 10 2013 215 386 | A1 | 2/2015 |
| EP | 0 276 275 | B1 | 3/1990 |
| EP | 1 201 788 | A1 | 5/2002 |
| EP | 1 258 542 | A2 | 11/2002 |
| GB | 960346 | A | 6/1964 |
| GB | 2138837 | A | 10/1984 |
| JP | H5-171459 | A | 7/1993 |
| JP | 2001-507755 | A | 6/2001 |
| JP | 2003-313678 | A | 11/2003 |
| JP | 2007-100186 | A | 4/2007 |
| JP | 2007-262577 | A | 10/2007 |
| JP | 2010-71557 | A | 4/2010 |

(Continued)

OTHER PUBLICATIONS

Arthur et al ("A review on the assessment of polymeric materials used as corrosion inhibitor of metals and alloys", International Journal of Industrial Chemistry vol. 4, Article No. 2, 2013). (Year: 2013).*

Muller ("Citric acid as corrosion inhibitor for aluminium pigment", Corrosion Science 46 (2004) 159-167) (Year: 2004).*

English abstract for DE-10 2013 215 386.

English abstract for DE-101 63 337.

English abstract for DE-37 44 032.

English abstract for DE-10 2006 033 465.

English abstract for DE-10 2007 057 777.

English abstract for DE-10 2009 013 054.

Chinese Office Action dated Apr. 9, 2021 for copending Chinese Application No. 201810366349.5.

(Continued)

*Primary Examiner* — Robert S Jones, Jr.
*Assistant Examiner* — Jiangtian Xu
(74) *Attorney, Agent, or Firm* — Fishman Stewart PLLC

(57) ABSTRACT

A method for producing a heat exchanger having at least one cooling line with a lightweight metal base through which a water-based coolant can flow may include passivating a surface of the at least one cooling line, which is in contact with the coolant, before the at least one cooling line is filled with the coolant.

19 Claims, No Drawings

(56) References Cited

FOREIGN PATENT DOCUMENTS

| | | | |
|---|---|---|---|
| JP | 2010-535324 | A | 11/2010 |
| WO | 2011/002040 | A1 | 1/2011 |

OTHER PUBLICATIONS

Chinese NPL document cited as D3 in Chinese OA—Chinese NPL document (title translated into English as "Preparation theory and technology of lamellar metal composites").

Japanese Office Action dated Jan. 25, 2022 related to corresponding Japanese Patent Application No. 2018-075855.

* cited by examiner

METHOD FOR PRODUCING A HEAT EXCHANGER

CROSS-REFERENCE TO RELATED APPLICATIONS

This application claims priority to German Patent Application No. DE 10 2017 206 940.6, filed on Apr. 25, 2017, the contents of which are incorporated herein by reference in its entirety.

TECHNICAL FIELD

The present invention relates to a method for producing a heat exchanger having at least one cooling line with a lightweight metal base, preferably on an aluminium base, through which a water-based coolant may flow. The invention further relates to a heat exchanger that is produced according to the inventive method.

BACKGROUND

In modern electric vehicles, heat exchangers are used to cool components called "traction batteries", enabling the temperature of the traction battery to be controlled by means of at least one coolant circuit. For safety reasons, the coolant in the cooling circuits of electric vehicles and the heat exchangers required therefor must not exhibit any electrical ionic conductivity. If insulation faults occur in the individual battery cells of the traction batteries, hazardous quantities of electricity can be transferred to the entire vehicle via the coolant circuit. If someone touches an affected surface, this can then lead to dangerous electric shocks. In addition, the quantities of current present in an ion-bearing, electrically conductive coolant containing water may lead to water hydrolysis, creating oxyhydrogen. This is true in particular for electric vehicles equipped with fuel cells such as hydrogen or metal-air fuel cells. In addition, the electric motors in electric vehicles must also be cooled. A coolant which has no ionic conductivity must be provided for these as well.

Modern heat exchangers for motor vehicles are typically manufactured from aluminium and brazed. It is known that the material aluminium combines with water to form a hydroxide-containing passivation layer, and in so doing releases not only OH ions but also metal salt ions into the coolant. These reactions ultimately result in a frequently undesirable increase in electrical conductivity in the coolant. Moreover, in some aluminium brazing processes a potassium-aluminium-fluoride complex salt may be used as the flux, which remains on the soldered surface even after the brazing process. Ions may also be released thereby upon contact with water. In higher concentrations, free fluorides may from this flux may also impair the additives in the coolant to such an extent that high-volume aluminium hydroxides are formed. These high-volume aluminium hydroxides may constrict or even completely clog or block the cooling ducts and/or cooling lines.

When filled with pure water, brazed heat exchangers which are made from aluminium exhibit electrical conductivity of at least 600 μS/cm. Heat exchangers which have been soldered with fluxes may exhibit electrical conductivities greater than 2000 μS/cm. The electrical conductivity can be reduced to a range from 400-500 μS/cm with the aid of various flushing processes. However, for the use of heat exchangers in electric vehicles electrical conductivities well below 100 μS/cm are needed.

SUMMARY

The present invention therefore concerns itself with the problem of describing a method for producing a heat exchanger with which it is possible to effect a passivation of the heat exchanger surface that may come into contact with a coolant, which passivation is characterized in particular by a reduction of electrical conductivity for an aqueous coolant.

This problems is solved according to the invention with the subject-matter of the independent claims. Advantageous embodiments constitute the subject-matter of the dependent claims.

The present invention is based on the general idea of passivating a heat exchanger, particularly the surfaces of the heat exchanger which may come into contact with a coolant, in such manner that an increase in electrical input conductivity of the coolant is at least reduced during operation. This means that with the aid of the method invention a surface with a lightweight metal base is created which releases significantly fewer ions upon contact with a water-based coolant, and raises the electrical conductivity of the coolant to a similar, significantly lower degree. In the course of a research project, surprisingly it proved possible to create a novel passivation on an aluminium surface with a certain mixture of chemicals comprising metals that form fluorine complexes, such as zirconium, and corrosion inhibitors in conjunction with elevated temperature and under increased pressure. This passivation layer is so stable, even in constant operation in the exemplary application in a heat exchanger, that the one input conductivity of a demineralised water does not increase by more than 70 μS/cm, and preferably not more than 20 μS/cm.

DETAILED DESCRIPTION

The following text is an exemplary process description of the method according to the invention for producing a heat exchanger of such kind, wherein the individual method steps are protected both individually and also in any combination within the scope of the invention.

For the passivation of the heat exchanger, a pickling pretreatment of the aluminium surface is advantageous. In this context, the heat exchanger may be flushed with a mildly alkaline solution having a pH vale of 7.5-12, preferably a pH value of 8-9, at 40-60° C. Then, the heat exchanger may be flushed with demineralised water, preferably several times. This may then be followed by a second pickling treatment with an acid that has been diluted with demineralised water. For example, a mixture of sulphuric acid and phosphoric acid may be used as the pickling acid solution. The acid is present in the demineralised water preferably in a concentration of 1-5 wt %, particularly preferably 2-3 wt %. In addition, the dilute acid may further contain 50-1000 ppm free fluorides. To complete the pickling pretreatment of the aluminium surface, preferably at least several flushing cycles may be performed with demineralised water. The pickling pretreatment is then followed by the actual passivation of the aluminium surface. For this purpose, the part is preferably warmed to 90-120° C. and then filled with a prewarmed passivation fluid, which will be explained in greater detail below. After a reaction time of 0.5-3 hours, the passivation is complete. After this, the part is flushed out preferably at least several times. The passivation fluid is preferably constituted from an aqueous sulphuric acid solution with pH value 2-6, wherein the following substances are dissolved preferably at a temperature of 40-80° C. The substances which are preferably dissolved in the passivation fluid are in particular sebacic acid 0.1-1 wt %, zirconium carbonate 20-50 wt % and triethanolamine 0.05-0.5 wt %. Corrosion inhibitors may also be added to the passivation fluid. The preferred quantity of the corrosion inhibitors used as additives according to the invention is preferably 0.005-10 wt %, particularly preferably 0.01-2 wt %.

In an advantageous variant of the idea according to the invention, the passivation is carried out in such manner that the electrical conductivity between the coolant and the cooling line of the heat exchanger is lower than 100 μS/cm and preferably lower than 50 μS/cm.

Another advantageous variant provides that the passivation of the surface is carried out in a chemical treatment with a passivation solution prepared on the basis of an aqueous sulphuric acid solution or organic acid solution, preferably with pH value 2-6.

In an advantageous embodiment, the passivation solution contains at least 0.1-1 wt % sebacic acid and/or at least 20-50 wt % zirconium carbonate and/or 0.05-0.5 wt % triethanolamine.

In an advantageous further development, the passivation solution further contains at least one corrosion inhibitor, which makes up a fraction of 0.005-10 wt %, preferably 0.01-2 wt % of the passivation solution.

An advantageous variant provides that the at least one corrosion inhibitor is selected from the following group of chemical compounds: pyrocatechol-3,5-disulphonic acid disodium salt, diethylenetriamine-penta-acetic acid, 8-hydroxy-(7)-iodo-quinoline-sulphonic acid-(5), 8-hydroxy-quinoline-5-sulphonic acid, mannitol, 5-sulphosalicylic acid, aceto-O-hydroxamide acid, norepinephrine, 2-(3,4-dihydroxyphenyl)-ethylamine, L-3,4-dihydroxyphenyl alanine (L-DOPA), 3-hydroxy-2-methyl-pyran-4-oη), citrates, carboxylates, in particular oxalates, alkaline salts of stearate and/or formiate and/or glyconate, and inorganic inhibitors such as sodium tetraborate, pyrophosphoric acid, calcium gluconate.

In an advantageous further development of the method according to the invention, the heat exchanger, in particular cooling line that is to be passivated is prewarmed, preferably to 90-120° C., prior to the passivation.

A further advantageous embodiment provides that the passivation solution is prewarmed, preferably to 40-80° C., before it is introduced into the cooling line that is to be passivated.

In a further advantageous variant, the temperature of the passivation solution is below, preferably at least 40° C. below the temperature of the cooling line that is to be passivated.

A further expedient embodiment provides that a reaction time during which the passivation of the cooling line surface takes place lasts for 0.5-3 hours. It should be noted that the reaction time may be of any duration without departing from the scope of the invention. No substantial further improvement of the passivation layer is achievable with a reaction time longer than 3 hours.

In an advantageous further development of the method, the cooling line surface that is to be passivated is pretreated for a first time preferably before the passivation by pickling with a mildly alkaline solution which preferably has a pH value of 7.5-12. The pickling pretreatment of the surface to be passivated may be repeated any number of times.

A further advantageous variant provides that the mildly alkaline solution has a pH value of 8-9 for the first pretreatment of the surface to be passivated, and is heated to a temperature of 40-60° C.

In an advantageous variant, the surface to be passivated undergoes a second pretreatment after the first pretreatment, which second pretreatment consists of a picking treatment with an acid mixture of sulphuric acid and/or phosphoric acid. It is also conceivable that the acid mixture contain an amidosulphonic acid. It should be noted that, as described earlier, organic acids may also be used according to the invention instead of inorganic acids for the pickling treatment of the surface that is to be passivated. For example, a citric acid and/or a formic acid may be used as the organic acid.

In an advantageous embodiment of the method, the acid mixture used in the second pretreatment contains at least 1-5 wt % sulphuric acid and/or phosphoric acid besides 95-99 wt % demineralised water. In an acid mixture containing an organic acid, this acid mixture preferably contains 20-30 g/l of the citric acid and/or formic acid in demineralised water mentioned above for exemplary purposes.

Another advantageous variant provides that the acid mixture also contains 50-1000 ppm free fluorides.

In an advantageous further development, it is provided that the surfaces of the cooling line that are to be passivated are rinsed multiple times with demineralised water after the respective pretreatment and/or after the passivation process.

A heat exchanger of such kind according to the invention is produced at least according to the method and/or passivated by means of the abovementioned method.

Of course, the features described in the preceding text are usable not only in each of the combinations described but also in other combinations or alone without departing from the scope of the present invention.

The invention claimed is:

1. A method for producing a heat exchanger having at least one cooling line with a metal base, through which a water-based coolant can flow, comprising:

pretreating a surface of the at least one cooling line with a first pretreatment, the first pretreatment including a pickling treatment with an alkaline solution; and pretreating the surface with a second pretreatment after the first pretreatment, the second pretreatment including a pickling treatment with an acid mixture including sulphuric acid and phosphoric acid;

passivating the surface, which is in contact with the coolant, before the at least one cooling line is filled with the coolant;

wherein passivating the surface is carried out by a chemical treatment with a passivation solution constituted on the basis of one of an aqueous sulphuric acid solution or an organic acid solution, and wherein the passivation solution contains 0.1-1 wt % sebacic acid, 20-50 wt % zirconium carbonate, and 0.05-0.5 wt % triethanolamine; and wherein the alkaline solution has a pH value from 8-9.

2. The method according to claim 1, wherein passivating the surface is carried out in such a manner that an electrical input conductivity of the coolant increases by less than 100 μS/cm during operation.

3. The method according to claim 1, wherein the passivation solution further includes at least one corrosion inhibitor, which makes up 0.005-10 wt % of the passivation solution.

4. The method according to claim 3, wherein the at least one corrosion inhibitor is selected from the following group of chemical compounds: pyrocatechol-3,5-disulphonic acid disodium salt, diethylenetriamine-penta-acetic acid, 8-hydroxy-(7)-iodo-quinoline-sulphonic acid-(5), 8-hydroxy-quinoline-5-sulphonic acid, mannitol, 5-sulphosalicylic acid, aceto-O-hydroxamide acid, norepinephrine, 2-(3,4-dihydroxyphenyl)-ethylamine, L-3,4-dihydroxyphenyl alanine (L-DOPA), 3-hydroxy-2-methyl-pyran-4-oη), citrates, carboxylates, alkaline salts of stearate and/or formiate and/or glyconate, and inorganic inhibitors such as sodium tetraborate, pyrophosphoric acid, calcium gluconate.

5. The method according to claim 1, further comprising prewarming the at least one cooling line before passivating the surface.

6. The method according to claim 1, further comprising prewarming the passivation solution, and then introducing the passivation solution into the at least one cooling line.

7. The method according to claim 5, wherein a temperature of the passivation solution is below a temperature of the at least one cooling line.

8. The method according to claim 1, wherein a reaction time during which passivating the surface takes place lasts for 0.5-3 hours.

9. The method according to claim 1, wherein the alkaline solution is heated to a temperature of 40-60° C.

10. The method according to claim 1, wherein the acid mixture contains at least 1-5 wt % of the sulphuric acid and phosphoric acid, and is 95-99 wt % demineralized water.

11. The method according to claim 1, carrying out multiple rinsing cycles of the surface of the at least one cooling line with demineralised water after at least one of the first pretreatment, the second pretreatment, and passivating the surface.

12. The method according to claim 1, wherein the passivation solution is constituted on the basis of the aqueous sulphuric acid solution and has a pH value of 2-6.

13. The method according to claim 5, wherein the at least one cooling line is prewarmed to 90° C.-120° C.

14. A method for producing a heat exchanger having at least one cooling line with a metal base, through which a water-based coolant can flow, comprising:

passivating a surface of the at least one cooling line, which is in contact with the coolant, before the at least one cooling line is filled with the coolant;

prewarming the at least one cooling line before passivating the surface; and wherein passivating the surface is carried out by a chemical treatment with a passivation solution constituted on the basis of one of an aqueous sulphuric acid solution or an organic acid solution, and wherein the passivation solution contains 0.1-1 wt % sebacic acid, 20-50 wt % zirconium carbonate, and 0.05-0.5 wt % triethanolamine.

15. A method for producing a heat exchanger having at least one cooling line with a metal base, through which a water-based coolant can flow, comprising:

passivating a surface of the at least one cooling line, which is in contact with the coolant, before the at least one cooling line is filled with the coolant;

wherein passivating the surface is carried out by a chemical treatment with a passivation solution constituted on the basis of one of an aqueous sulphuric acid solution or an organic acid solution, and the passivation solution includes at least one corrosion inhibitor, which makes up 0.005-10 wt % of the passivation solution; and wherein the passivation solution contains 0.1-1 wt % sebacic acid, 20-50 wt % zirconium carbonate, and 0.05-0.5 wt % triethanolamine.

16. The method according to claim 15, wherein the passivation solution is constituted on the basis of the aqueous sulphuric acid solution and has a pH value of 2-6.

17. The method according to claim 15, wherein the at least one corrosion inhibitor is selected from the following group of chemical compounds: pyrocatechol-3,5-disulphonic acid disodium salt, diethylenetriamine-penta-acetic acid, 8-hydroxy-(7)-iodo-quinoline-sulphonic acid-(5), 8-hydroxyquinoline-5-sulphonic acid, mannitol, 5-sulphosalicylic acid, aceto-O-hydroxamide acid, norepinephrine, 2-(3,4-dihydroxyphenyl)-ethylamine, L-3,4-dihydroxyphenyl alanine (L-DOPA), 3-hydroxy-2-methyl-pyran-4-oη), citrates, carboxylates, alkaline salts of stearate and/or formiate and/or glyconate, and inorganic inhibitors such as sodium tetraborate, pyrophosphoric acid, calcium gluconate.

18. The method according to claim 14, wherein the passivation solution is constituted on the basis of the aqueous sulphuric acid solution and has a pH value of 2-6.

19. The method according to claim 14, wherein the at least one cooling line is prewarmed to 90° C.-120° C.; and further comprising prewarming the passivation solution to a temperature of 40° C.-80° C. and at least 40° C. below that of the at least one coolant line.

* * * * *